United States Patent [19]

Hornschemeyer et al.

[11] Patent Number: 4,735,435

[45] Date of Patent: Apr. 5, 1988

[54] FRONT-PIECE FOR A SAFETY SKI-BINDING

[75] Inventors: Heinz Hornschemeyer, Oberammergau; Anton Emert, Oberau, both of Fed. Rep. of Germany

[73] Assignee: Marker Deutschland GmbH, Garmisch-Partenkirchen, Fed. Rep. of Germany

[21] Appl. No.: 871,065

[22] Filed: Jun. 5, 1986

[51] Int. Cl.[4] ..... A63C 9/08

[52] U.S. Cl. ..... 280/625; 280/634

[58] Field of Search ..... 280/634, 625, 628, 636

[56] References Cited

U.S. PATENT DOCUMENTS 3,734,521 5/1973 Payrhammer ..... 280/625
4,336,956 6/1982 Richert et al. ..... 280/625
4,516,792 5/1985 Scheck et al. ..... 280/634
4,593,928 6/1986 Scheck et al. ..... 280/625

FOREIGN PATENT DOCUMENTS 2030749 2/1979 Fed. Rep. of Germany ..... 280/634

*Primary Examiner*—David M. Mitchell

*Attorney, Agent, or Firm*—D. Peter Hochberg; Mark M. Kusner; Walter C. Danison, Jr.

[57] ABSTRACT

A front piece for safety ski bindings having a sole holder adapted to be pivoted sideways against the force of a spring and serving to support the ski boot sole sideways and towards the front, a pedal for actuating a control mechanism which maintains the release resistance at least approximately constant and independent of the variable pressure applied to the pedal.

5 Claims, 3 Drawing Sheets

KEA 53
58
58
a 65
64
63
61
57

51
VI
48
49
50
53
56
55
62
57
65
VII
VI
61
2
60
59
52
54

49
51
58
53
1
55
2
61
57
65
59
48
50
52
58
1
56
54

FRONT-PIECE FOR A SAFETY SKI-BINDING

The present invention relates to a front-piece for safety ski-bindings.

Front pieces or toe pieces for safety ski bindings composed of a single, centrally located member or a pair of symmetrically mounted members, in either case being mounted to pivot sideways against a spring force in response to side forces on a boot held in the binding are known. It is also known to provide such bindings with a control mechanism which is actuated by a pedal for maintaining the release resistance generally constant regardless of variations in the forces applied to the pedal. Such front pieces are known, for example, from German Auslegeschrift No. 2030749 and German Pat. No. 2905837. The front-piece disclosed in the German Auslegeschrift No. 2030749 comprises a sole-holder which is held in its normal position by means of a detent device. In this known detent device, a detent resistance is provided which acts against a sideways pivotal movement of the sole-holder, which resistance is reduced if the body of the skier is shifted forwardly so as to balance the friction between the ski boot and the ski surface (or a slide plate), i.e. a friction which opposes the sideways movement of the sole holder. Control means are used which control the detent engagement of a detent member in a detent indentation depending on the pressure of the ski boot onto a pedal in the area of the ball of the boot such that for increasing pressure at the ball of the boot, the detent engagement is reduced and the spring force acting on the detent member is decreased, respectively. Therefore, the resistance of the detent means is reduced by approximately the amount of the frictional resistance. These control means are quite complicated and subject to malfunction, and they are generally subject to a large amount of wear, inasmuch as they act against the detent spring. For that reason, such known front pieces are not used on bindings in the market.

German Pat. No. 2905837 discloses a front-piece providing for an extended movement. Such a binding is without a detent means and automatically returns into its operating position after the tip of the ski boot has been released. For that front piece provision is made that an auxiliary force is generated by means of the pressure of the ball of the foot which acts via a control means. This auxiliary force offsets the release force, so as to balance the occuring friction. The auxiliary force acts upon the effective end of the spring in a sense such that the sole holder(s) is (are) relieved. In any event, the auxiliary force has to be smaller than the bias of the spring which has to be overcome for purposes of release. This has as a consequence that for these known designs the movable parts and the bearing parts of the control means are subject to a great amount of wear. For that reason front-pieces of the foregoing type have not been introduced into the market.

It is an object of the present invention to provide an improved front-piece for a safety ski binding having a release resistance to side forces which remains generally constant regardless of variations in forces applied at the ball of the foot to the front piece.

It is another object to provide such a front piece with movable parts which are not subject to an excessive degree of wear.

A further object is the provision of such a front piece for a ski binding wherein compensation of the frictional forces is obtained with only a few new elements and materials, so that the front-piece cannot only be manufactured in a simpler and less expensive way, but is also less prone to malfunction.

In accordance with the invention in its preferred forms, the above and other objects are achieved by providing a lever arm by which the force of a release resistance spring is transmitted can be adjusted by means of a control mechanism such that with increasing pressure on the pedal from the ball of a skier's foot, the lever arm is reduced in its length. Due to the pressure depending decrease of the length of the lever arm an automatic reduction of the release resistance is caused, the release resistance being due to the force transmitted by the lever arm, i.e. the transmitted moment. As a result of the design of the preferred forms of the invention the entire or total release resistance which includes the frictional resistance is kept at least approximately constant. In contrast to the prior art, the force of the release spring is not influenced by the control means. This has the consequence that the control means can be designed and built in a light and simple manner.

Other objects and advantages of the invention will become apparent upon reading the following detailed description and upon reference to the drawings, in which.

Figures 1, 2:
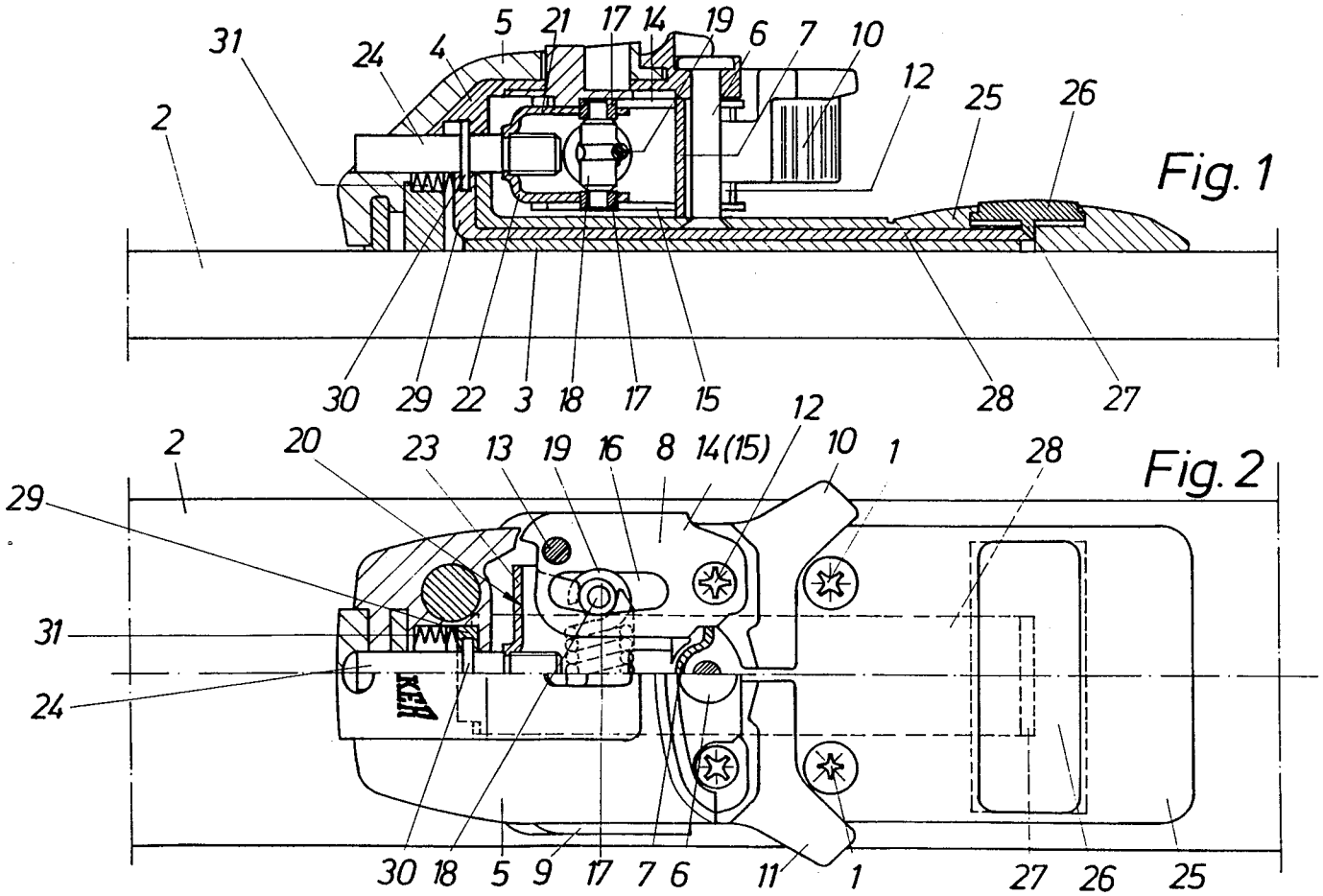
FIG. 1 is a central longitudinal cross-sectional view of the front-piece of a first embodiment of the invention, with the mounting of the spring not being shown as a cross-sectional view.
FIG. 2 is a partially cut plan view of the front-piece of FIG. 1.

The front-piece shown in FIGS. 1 and 2 comprises a housing mounted on a ski 2 by means of screws 1. The housing comprises an upper portion 4, a bottom portion 3 and a cover cap 5 with all said elements being fixedly mounted together. With regard to FIG. 1 the housing has in substance the form of a U. The legs of the U are connected to each other by means of a centrally located rivet 6. In the area of this riveting a separating member 7 is provided between those legs. The separating member 7 serves with its two side-edges as an abutment for a pair of pivot levers 8 and 9, respectively. The pivot levers 8 and 9, respectively, form supporting members for two sole-holders 10 and 11. Each of sole-holders 10, 11 is connected with its supporting member by means of a vertically arranged screw 12. Each of sole-holders 10, 11 is screwed onto its screw 12. It should be noted, however, that screw 12 is supported in the supporting member in a rotatable but axially immovable manner. Each of pivot levers 8, 9 is pivotally mounted on an axis forming bolt 13. Bolts 13 are arranged between the legs of the housing and extend parallel to rivet 6. In FIG. 2 only bolt 13 for pivot lever 8 is shown. The second bolt which is arranged symmetrically with respect to the first-mentioned bolt cannot be seen in FIG. 2 because it is covered by cover cap 5.

The pivot levers and sole-holder support members 8, 9, respectively, are formed as sheet metal parts of substantially U-shape. The legs 14, 15 extend parallel to the ski surface towards the longitudinal axis of the front piece (see FIG. 2). Each of legs 14, 15 comprises an elongated hole 16 in alignment with each other. In each one of elongated holes 16 a guide roller 17 is guided, guide roller 17 being rotatably mounted on the same axle 18. Between the two guide rollers 17 of each pivot lever 8, 9 the hook-shaped end of a pulling spring 19 is mounted on each of the axles. Pulling spring 19 will normally maintain the pivot levers 8, 9 in abutment with separating member 7. The guide-rollers 17, besides being guided in elongated holes 16, are also guided in a guide or supporting member 20. Member 20 is also a substantially U-shaped sheet metal member having legs 21, 22 which extend parallel to the legs of the pivot levers 8, 9 and in-between the legs of said pivot levers 8, 9 (see FIG. 1).

The side faces of legs 21, 22 are recessed. These recesses do receive the guide rollers 17 in the normal position of the pivot levers 8, 9. A web 23 of member 20 is provided with a threaded hole into which the shaft of a screw 24 is threaded. Screw 24 holds member 20 in the housing. The front-piece described so far is known from the prior art so that an even more detailed description is not necessary. Regarding the structure and the function, reference is made for example to German Pat. No. 2034355.

The bottom portion 3 of the housing is extended at its one part which forms one of the U-legs. The extension of this one part goes beyond the connecting rivet 6 and forms a stepping plate 25 in which a pedal 26 is vertically movable in a limited manner. This pedal forms part of a control means of the preferred forms of the invention. The control means serves to keep the release resistance at least substantially constant, regardless of the variable pressure applied to pedal 26.

Pedal 26 is provided at its bottom side with a push wedge 27 for the actuation of a slide element 28. The slide element 28 is movably mounted in longitudinal direction in the leg of the bottom portion of the housing. The slide element 28 has, as shown in the figure, at its left end a vertically extending angle portion 29. The angle portion 29 comprises a recess for fittingly receiving a collar 30 which is provided on the screw 24. Also acting on the angle portion 29 is a reset spring 31 which is supported in the housing. The reset spring 31 maintains the slide element 28 and consequently also the pedal 26 in their respective normal positions. In the event that a ski boot presses the pedal downwards due to increased load on the ball of the foot, then this has the consequence of moving the slide element 28 and, consequently, the screw 24. Inasmuch as the guide and supporting member 20 is screwed to the screw 24 member 20 as well as the spring 19 supported by member 20 are moved. As a consequence, the length of the force arm by means of which the spring 19 acts upon the support members 8, 9 is shortened, with support members 8, 9 being supported by axis-forming bolts 13. As a result, the release resistance of the spring is reduced and therefore the frictional resistance is compensated for the respective large load of the ball of the foot, so that the entire release resistance with respect to the sideward release of the ski boot is at least approximately kept constant.

Figure 3:
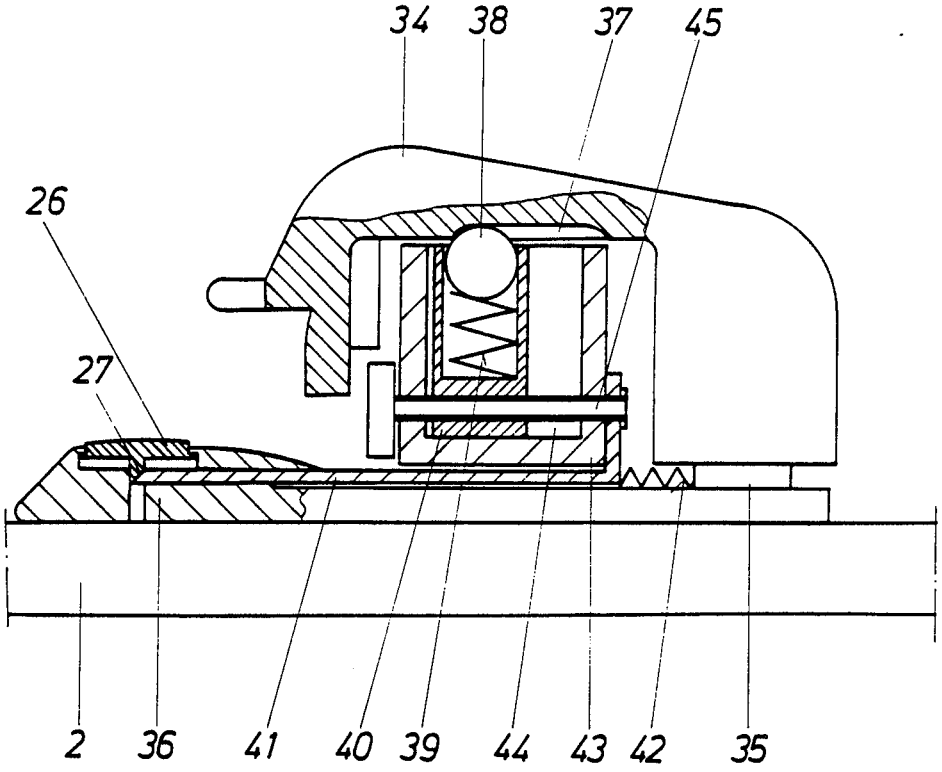
FIG. 3 is a front-piece according to a second embodiment in a partially cut side view.

The front piece of FIG. 3 is provided with a centrally located sole holder 34, sole holder 34 being pivotally mounted on a vertical axis 35. The axis 35 is, as is customary, riveted to a base plate 36, a base plate which is in turn screwed to the ski 2. By means of a detent device the sole holder is locked in its normal position. This detent device comprises a detent groove 37, a detent ball 38 and a detent spring 39 acting upon ball 38. The detent groove is located in the sole holder, while the detent ball 38 is arranged together with the detent spring 39 in a spring cage 40. The spring cage 40 is mounted to the base plate 36 in a manner described below.

As was described in connection with the front piece shown in FIGS. 1 and 2, the present front piece is also provided with a pedal 26, a pedal which is movably mounted in the base plate 36 in a vertically limited manner. The push wedge 27 at the bottom side of the pedal acts also in the present case together with a slide element 41, a slide element which is movably mounted in longitudinal direction in base plate 36. The slide element 41 is again under the influence of a reset spring 42, which is supported at axis 35. The slide element 41 carries a support 43, said support 43 comprises a longitudinal recess 44 adapted to receive the spring cage 40. A screw 45 is rotatably but not axially movably supported in support 43. Spring cage 40 is screwed to the shaft of screw 45. By means of actuation of screw 45 the position of spring cage 40 in longitudinal recess 44 of support 43 may be changed at will, and consequently also the release resistance of the detent spring 39.

Similarly to the operation of the first-mentioned embodiment, it is also true for this embodiment that an increasing load of the ball of the foot moves the pedal 26 downwardly, a downward movement which causes the movement of slide element 41 towards the right (see FIG. 3). Due to this movement the distance between the detent ball 38 and the pivot axis 35 is shortened which causes an automatic reduction of the release resistance of the detent spring 39. Therefore, in accordance with this embodiment of the invention, the frictional resistance occuring during the sideways release is correspondingly compensated for high ball-of-foot loads, and the total release resistance is maintained approximately constant.

A third embodiment of a front piece according to the invention is shown in FIGS. 4 to 9. A centrally located sole holder 48 is linked via an axis pin 49 to a sole holder support member 50. The sole holder support member 50 is, in turn, pivotally mounted on a vertical axle 51. The axis 51 is, in turn, riveted to a base plate 52, and base plate 52 is screwed by means of screws 1 onto a ski 2. The sole holder 48 may be secured in its normal position with respect to the sole holder support member by means of a centering spring not shown. The sole holder support member is under the influence of a pressure member 53. The pressure member 53 is under the load of a coil pressure spring 54 and keeps the sole holder support member 50 in its normal position.

Spring 54 abuts against a vertical cross wall 55, a cross wall which is fixedly connected with the base plate or which is formed as a single piece together with the base plate. The cross wall 55 is arranged on a shaft 56 of the pressure member 53. The shaft 56 is rotatably and axially movably mounted in a bore of the cross wall 55. The end of the shaft 56 is provided with teeth 57. The pressure member 53 is provided at its side opposite to the spring 54 with two teeth 58 which are arranged diametrically opposed to each other. The tips of teeth 58 serve as pressure transfer points and normally center the sole holder support member 50 symmetrically with respect to the vertical longitudinal plane of the front piece.

Figures 4, 5, 6, 7, 8, 9:
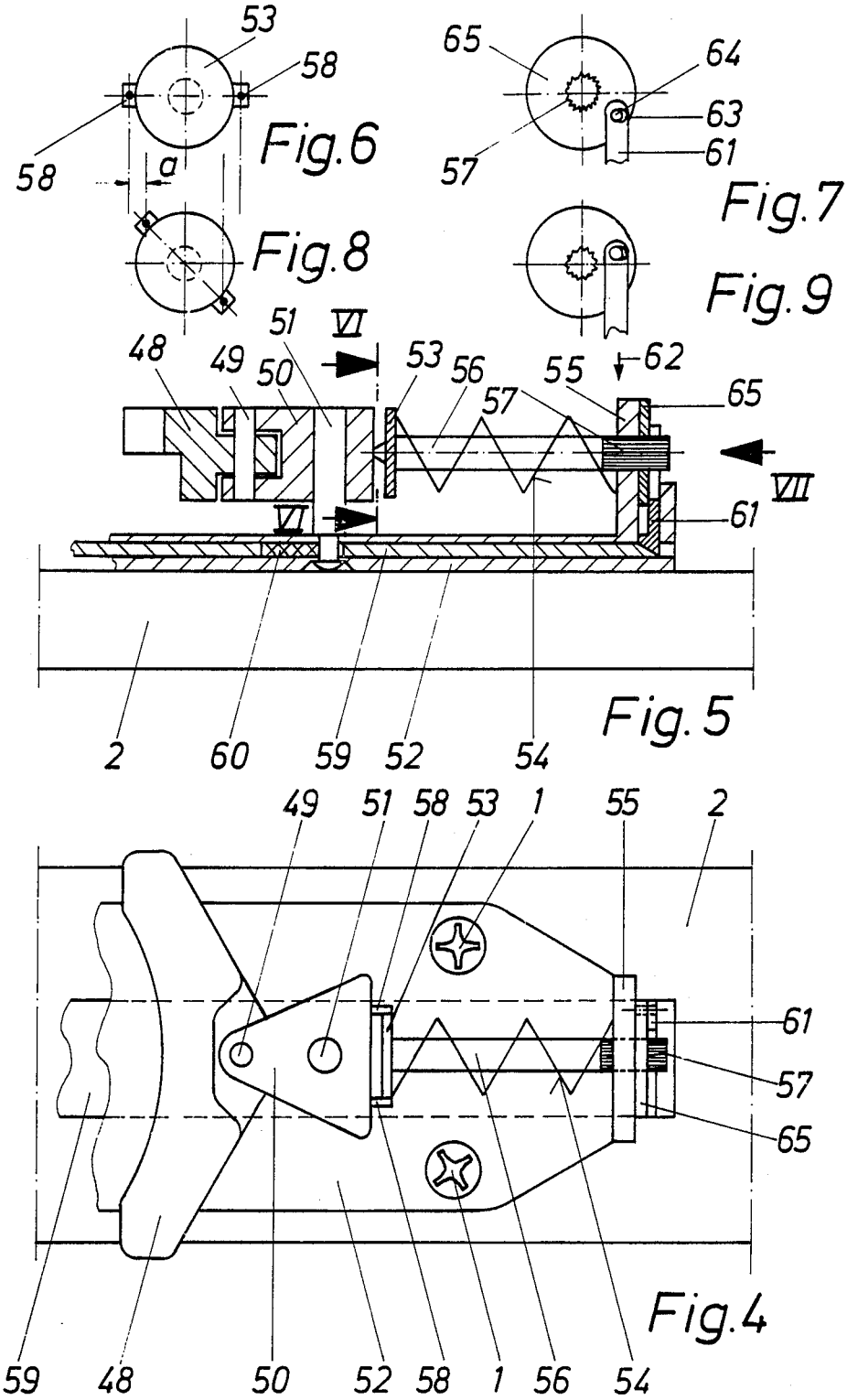
FIG. 4 is a plan view of a front-piece of another embodiment.
FIG. 5 is a central longitudinal sectional view of the front-piece of FIG. 4.
FIG. 6 is a sectional view along line VI—VI in FIG. 5.
FIG. 7 is a plan view seen from arrow 7 in FIG. 5.
FIGS. 8 and 9 are representations similar to FIGS. 6 and 7 in a situation where the control means are actuated.

Again, for this embodiment of the invention, as was true for the embodiments described above, a pedal which is not shown is provided. This pedal again is movably mounted on the base plate 52 in a vertically limited manner and it cooperates by means of a push wedge with a slide element 59. Again slide element 59 is movably mounted in the base plate in the longitudinal direction of the front piece. The slide element 59 comprises an elongated hole. The axis 51 extends (see FIG. 5), through the elongated hole and a reset spring, for instance a rubber spring 60, is received in the elongated hole; reset spring 60 abuts axle 51. As is shown in FIGS. 4 and 5 the right-hand end of the slide member 59 cooperates with the vertically movable step 61 which is mounted in the cross wall 55. Stem 61 is also under the influence of a reset spring which is not shown in FIG. 9 and which is represented by the arrow 62. Stem 61 is provided at its free end with an elongated hole 63 extending transversly with respect to the direction of movement. A crank pin 64 is in engagement with elongated hole 63. Crank pin 64 is provided at a rotary disc 65. The rotary disc 65 is arranged on the toothed end of the shaft 56. The rotary disc 65 is provided for this purpose with a hole having corresponding meshing teeth. Consequently, the shaft 56 is not rotatable with respect to the rotary disc 65, but axially movable. The rotary disc 65 is secured against axial movement by means of the stem 61.

As is true for the embodiments described above, for the present embodiment an increase in the ball-of-the-foot load causes, via the pedal, a movement of the slide element 59 towards the right-hand side looking at FIGS. 4 and 5. The slide element 59 moves the stem 61 upwardly during such movement as a consequence of which movement the rotary disc 65 is moved from its position shown in FIG. 7 to its position shown in FIG. 9. Simultaneously, this movement causes a rotary movement of the shaft and, consequently, of the pressure member 53 from the position of FIG. 6 to the position of FIG. 8. Therefore, the distance of the pressure transfer points of the pressure member 53 with respect to the vertical longitudinal plane is reduced by the amount "a". This distance is now the arm of the moment due to the force of the spring 54. According to this embodiment of the invention the release resistance of the spring is varied depending on the pressure of the ball of the foot such that for the sideways release of the front piece the total release resistance is in each case approximately the same.

In accordance with another feature of the invention, a control means is provided between the sole holder and the spring, a control means which moves the spring in the above-described sense. The control means is provided such that even in the reverse situation with heavy backward load the friction between the ski boot sole and the sole holder is compensated, a friction which will influence the sideways release. This feature is particularly valuable for a so-called single linkage front piece.

The invention has been described in detail with particular emphasis on the preferred embodiments, but it should be understood that variations and modifications within the spirit and scope of the invention may occur to those skilled in the art to which the invention pertains.

We claim:

1. A front piece for a safety ski-binding comprising:

a pair of sole holders symmetrically disposed on axially opposite sides of said ski for supporting a ski-boot sole laterally and from the front, each of said sole holders being rotatable about a pivot axis between a boot holding position and a boot release position, said sole holders being operable to release against a biasing force in the event that excessive side forces occur on said ski-boot sole;

biasing means acting on said sole holders exerting said biasing force thereon and defining a first release resistance acting on said ski boot, said biasing means acting on each of said soleholders a predetermined distance from its respective pivot axis thereby defining a first moment arm about said respective pivot axis;

pedal means positioned to engage the ball of the skier's foot, said pedal means responsive to the normal force exerted by the skier's foot on said ski, said normal force creating a frictional force between said boot and said pedal means defining a second release resistance acting on said ski boot;

control means responsive to said pedal means for shifting the position of said biasing means relative to said sole holders, said control means reducing the force moment arms about said pivot axes when said normal force exerted on said pedal increase and thereby reducing said first release resistance such that the total release resistance of said first and second release resistance acting on said boot is maintained approximately constant.

2. A front piece as defined in claim 1 wherein said biasing means extends transversely to the axis of said ski, and said control means shifts said biasing means along said axis.

3. A front piece as defined in claim 1 wherein:

said biasing means includes spring means operatively associated with each of said sole holders, and guide means movable along said axis of said ski for supporting and guiding said spring means; and, said control means includes a movable element influencing said guide means in response to said normal forces on said pedal means.

4. A front piece as defined in claim 3 wherein: said guide means includes spindle means which is axially adjustable therein, said spindle means being supported by said movable element wherein said spindle means is rotatable but axially stationary with respect to said movable element, movement of said movable element shifting said spindle means together with said guide means.

5. A front piece as defined in claim 4 wherein said movable element is mounted in a central, vertically oriented, longitudinal plane with respect to said front piece.

* * * * *